US006857522B2

(12) United States Patent
Joersz

(10) Patent No.: US 6,857,522 B2
(45) Date of Patent: Feb. 22, 2005

(54) GENEALOGY INFORMATION STORAGE AND RETRIEVAL SYSTEM AND APPARATUS

(76) Inventor: Don Joersz, Box 496, Kahlotus, WA (US) 99335

( * ) Notice: Subject to any disclaimer, the term of this patent is extended or adjusted under 35 U.S.C. 154(b) by 0 days.

(21) Appl. No.: 10/213,839

(22) Filed: Aug. 5, 2002

(65) Prior Publication Data

US 2004/0020817 A1 Feb. 5, 2004

(51) Int. Cl.[7] ..... B65D 85/00; A61G 17/00; G09F 19/00; E01F 9/011

(52) U.S. Cl. ..... 206/459.5; 206/19

(58) Field of Search ..... 206/19, 459.5, 206/449, 525, 451; 27/1; 40/124.5; 220/212, 484

(56) References Cited

U.S. PATENT DOCUMENTS 4,463,527 A * 8/1984 Schlosser ..... 52/103
5,553,426 A * 9/1996 Ostergaard ..... 52/103
5,704,103 A * 1/1998 Crowley et al. ..... 27/1
5,729,921 A * 3/1998 Rojas ..... 40/124.5
5,916,815 A * 6/1999 Lappe ..... 436/92
6,006,458 A * 12/1999 Weiss ..... 40/124.5
6,076,292 A * 6/2000 Kawa ..... 40/124.5
6,088,955 A * 7/2000 Nelson et al. ..... 47/41.1
6,112,382 A * 9/2000 Parker et al. ..... 27/1
6,175,995 B1 * 1/2001 Parker et al. ..... 27/1
6,264,032 B1 * 7/2001 Hobbs ..... 206/449
6,295,705 B1 10/2001 Gersten
6,363,635 B1 * 4/2002 England ..... 40/124.5
6,463,703 B1 * 10/2002 Mattis ..... 52/103

* cited by examiner

*Primary Examiner*—Jacob K. Ackun
*Assistant Examiner*—Faye Francis
(74) *Attorney, Agent, or Firm*—Floyd E. Ivey; Liebler, Ivey, Connor, Berry & St. Hilaire

(57) ABSTRACT

The invention provides an apparatus for storage and retrieval, at a grave site, of genealogical information.

2 Claims, 1 Drawing Sheet

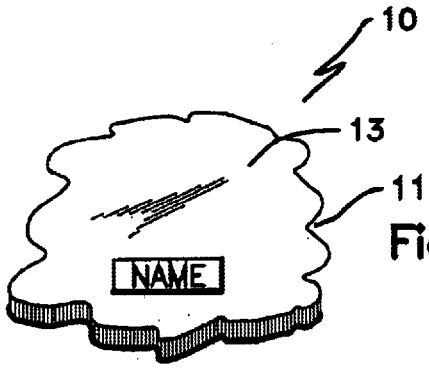
Fig. 1
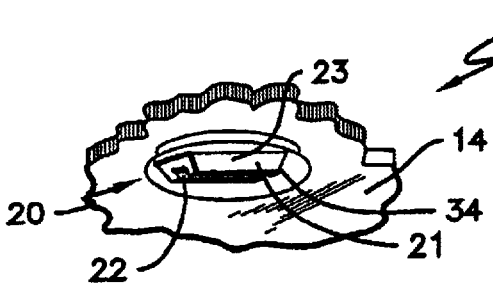
Fig. 2
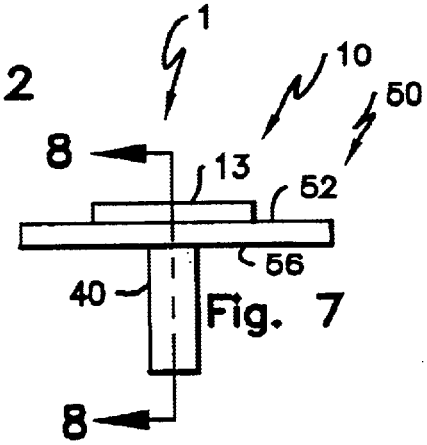
Fig. 7
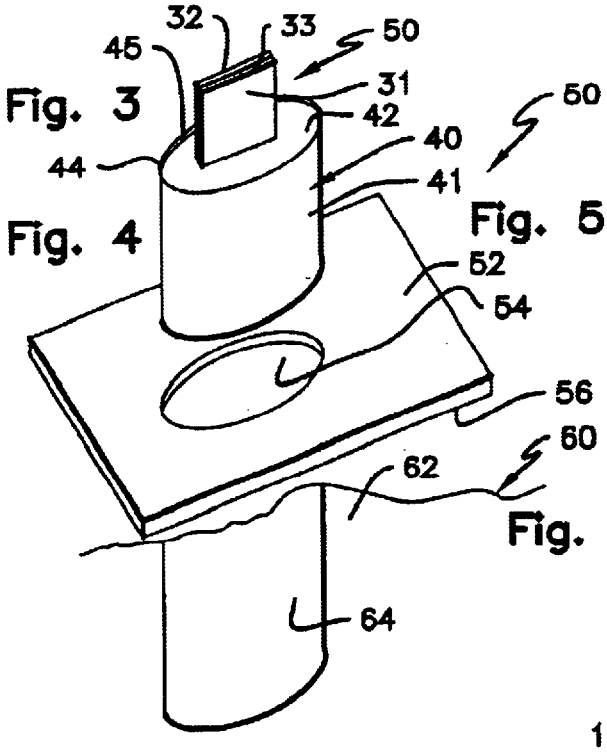
Fig. 3
Fig. 4
Fig. 5
Fig. 6
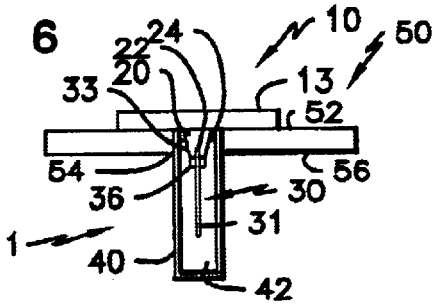
Fig. 8

GENEALOGY INFORMATION STORAGE AND RETRIEVAL SYSTEM AND APPARATUS

FIELD OF THE INVENTION

This invention relates generally to the storage and retrieval of genealogical information and specifically to the storage and means of retrieval of such information at a grave or burial site.

BACKGROUND OF THE INVENTION

Individuals interested in genealogical information frequently visit graveyards, columbarium and other sites where remains of the deceased are placed. Headstones and other inscriptions are generally found but with little more information than the name, date of birth and date of death. Such is often not of great assistance in the pursuit of genealogical information. Prior art regarding apparatuses or methods of providing additional information at such sites is seen in the patent to Gersten, U.S. Pat. No. 6,295,705 B1. The patents referred to herein are provided herewith in an Information Disclosure Statement in accordance with 37 CFR 1.97.

SUMMARY OF THE INVENTION

The GENEALOGY Information Storage and RETRIEVAL System and Apparatus herewith disclosed is a cylinder removably affixed to a cap or top. A concrete stepping stone with an aperture receives the cylinder. The cap or top may be grasped by an individual allowing RETRIEVAL of the cylinder. The cap or top, at the portion of the cap or top encompassed by the cylinder, receives genealogical information capable of viewing. The genealogical information, in the preferred embodiment, will be a card bearing information relative to genealogical interests. The card will be laminated with one edge of the card received into a slot in the cap or top, at the portion of the cap or top encompassed by the cylinder, and fixed by fixing means to said slot. Following viewing, the cap or top is replaced on the cylinder and the cylinder replaced or received into the concrete stepping stone aperture.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein:

FIG. 1 is a top perspective of the cap showing a name plate.

FIG. 2 is a bottom perspective of the cap showing the card fixing means as a protrusion having a slot.

FIG. 3 is a perspective view of the card showing the card 30 upper end 32 and upper segment 33 fixedly received 36 into the slot.

FIG. 4 is a perspective of the container showing the container aperture.

FIG. 5 is a top perspective of the concrete stepping stone with stepping stone aperture.

FIG. 6 is a cutaway view of the excavation over which the stepping stone is placed and the excavation into which the container is received.

FIG. 7 is an elevation showing the cap, stepping stone and container.

FIG. 8 is a cross-section from FIG. 7 showing the cap, card fixing means with perimeter, stepping stone, container and card.

DETAILED DESCRIPTION

The GENEALOGY Information Storage and RETRIEVAL System and Apparatus 1 is illustrated in FIGS. 1 through 8 showing the preferred embodiment of the invention. FIG. 1 shows the cap 10 having a cap top and bottom 13, 14. A name plate 11 is depicted at the top 13. A fixing means 20 to receive genealogical information capable of viewing to receive is depicted at the bottom 14. The preferred embodiment of the card fixing means 20 is a protrusion 21 having a slot 22 formed therein. The fixing means 20 of the preferred embodiment is formed integral with the casting or formation of the top or may be separately attached to the bottom 14 for example by welding, glueing, riveting or by other attaching means recognized by those of ordinary skill in the attaching art. Those of ordinary skill in the art will recognize that other fixing means 20 structures will be included, e.g., a plastic or metal tab affixed to the cap bottom 14 and protruding downward, when the cap 10 is positioned, with the card 30 affixed by affixing means, to the tab. As an alternative structure the card may be directly affixed to the cap 10 at the bottom 14 by any of several affixing means appreciated by those of ordinary skill in affixing.

The genealogical information, in the preferred embodiment, will be a card 30 having an information segment 31 upon which will be stated pertinent genealogical information. The card 30 may be composed of paper, plastic, metal or any other material capable of receiving an inscription of information. The card 30 at an upper end 32 will have a upper segment 33 which will be fixedly received 36 into the slot 22 with fixing means including epoxy, glue, rivet, screw, bolt and where the card 30 is composed of a metal by welding and by other fixing means known to those of ordinary skill in the fixing art. The card 30, in the preferred embodiment, will be composed of laminated paper with the upper segment 33 received into the slot 22 in the card fixing means 20.

The card fixing means 20 has a perimeter 23. A container 40, composed in the preferred embodiment of a cylinder 41 of a length of pcv pipe but which could be other plastics, metals and other materials and of a variety of cross-sections including circular, rectangular and other cross-sections. The container 40 has a container upper end 44 and a container aperture 42 formed to receive the card 30. One of ordinary skill in the art will recognize that the container aperture 42 may be the inside of a pvc pipe, a slot or any shape capable of receiving the card 30.

The card fixing means 20 perimeter 23 will have, in the preferred embodiment, a friction, snap, threaded or other interconnecting means comprising container 40 engagement means 24. The container 40 engagement means 24 will mate with the container upper end 44 which will have the corresponding friction, snap, threaded or other interconnecting means recognized by those of ordinary skill in the interconnecting arts. In the preferred embodiment, container 40 engagement means 24 will allow the connection and removal of the container 40 at and from the card fixing means 20 perimeter 23.

In the preferred embodiment the container 40 is received at a concrete stepping stone 50 having an stepping stone aperture 54 therein to receive the container 40. It will be recognized that the container 40 may be received by structures other than concrete stepping stones 50 including, for example, metal plates, stone slabs and other such materials capable of having a stepping stone aperture 54. In the preferred embodiment the stepping stone 50 will be placed in the immediate vicinity of a grave or grave marker 60 at a location 62 where an excavation 64 can be effected to permit the container 40 to extend through the stepping stone aperture 54 and into the excavation 64.

When received into the stepping stone aperture 54 and excavation 64, the cap 10 may be grasped by an individual allowing retrieval of the container 40, the disengagement of the container 40 from the container 40 engagement means 24 thereby revealing for viewing the card 30.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A Genealogy Information Storage and Retrieval System and Apparatus comprising:

a. a cap 10 having a cap top and bottom 13, 14; an information fixing means, receives information which is capable of viewing, at the bottom 14;

b. a container 40 having a container aperture 42 receives the information; interconnecting means interconnects the bottom 13 and the container 40; the container 40 is received at a concrete stepping stone 50 having an stepping stone aperture 54 therein which receives the container 40;

c. the information is composed of a card 30 having an information segment 31 upon which is stated pertinent information; the card 30 is composed of paper, plastic, or metal material capable of receiving an inscription of information;

d. information fixing means is composed of a card fixing means; the information fixing means 20 has perimeter 23: the perimeter 23 provides interconnecting means comprising container 40 engagement means 24;

e. the container 40 having a container upper end 44 and a container aperture 42 formed to receive the card 30; the container aperture 42 is the inside of a pvc pipe, or a slot capable of receiving the card 30;

f. the information fixing means 20 is a protrusion 21 having a slot 22 formed therein; the fixing card means 20 is formed integral with a casting or formation of the cap 10 or separately attached to the bottom 14 for attaching means;

g. the card 30 at an upper end 32 has an upper segment 33 which is fixedly received 36 into the slot 22 with fixing means;

h. the container 40 engagement means 24, will mate with the container upper end 44 which has interconnecting and corresponding friction, snap, or threaded interconnecting means.

2. The invention of claim 1 further comprising:

a. the container 40 engagement means 24 allows a connection and removal of the container 40 at and from the card fixing means 20 perimeter 23; the container 40 is composed of a cylinder 41 of pipe which can be pcv, other plastics, or metals; the cylinder 41 has a cross section;

b. the card 30, in the preferred embodiment, is composed of laminated paper with the upper segment 33 received into the slot 22 in the card fixing means 20;

c. the stepping stone 50 is placed in a location 62 where an excavation 64 can be effected to permit the container 40 to extend through the stepping stone aperture 54 and into the excavation 64;

d. a name plate 11 is depicted at the top 13;

e. when the container 40 is received into the stepping stone aperture 54 and excavation 64, the cap 10 may be grasped by an individual allowing retrieval of the container 40, the disengagement of the container 40 from the container 40 engagement 155 means 24 thereby reveals the card 30 for viewing.

* * * * *